United States Patent [19]

Kupersmit

[11] 3,949,929

[45] Apr. 13, 1976

[54] COLLAPSIBLE CONTAINER CONSTRUCTION HAVING HOOK AND PILE INTERCONNECTING MEANS

[76] Inventor: Julius B. Kupersmit, 145-80 228th St., Springfield Gardens, New York, N.Y. 11413

[22] Filed: Dec. 13, 1974

[21] Appl. No.: 532,707

[52] U.S. Cl. ..... 229/23 C; 206/386

[51] Int. Cl.[2] ..... B65D 19/20

[58] Field of Search ..... 206/386; 229/23 R, 23 C

[56] References Cited

UNITED STATES PATENTS

| | | | |
|---|---|---|---|
| 3,125,277 | 3/1964 | Kozlowski | 229/27 |
| 3,443,737 | 5/1969 | Kupersmit | 229/23 C |
| 3,490,583 | 1/1970 | Cook | 206/386 |
| 3,650,459 | 3/1972 | Tucker | 206/386 X |

*Primary Examiner*—Leonard Summer
*Attorney, Agent, or Firm*—Charles E. Temko

[57] ABSTRACT

A collapsible reusable shipping container construction of a type including a relatively rigid pallet which forms a floor, and erectable fiberboard walls and top which are hingedly connected to the pallet to be erected for use, and alternately folded against the pallet for empty return shipment. Hook and pile interconnecting means for interconnecting free edges of the side walls selectively to the pallet are provided, said means being so situated that the weight of the cargo tends to maintain the hook and pile means in engaged condition to prevent accidental disengagement.

3 Claims, 9 Drawing Figures

FIG. 3
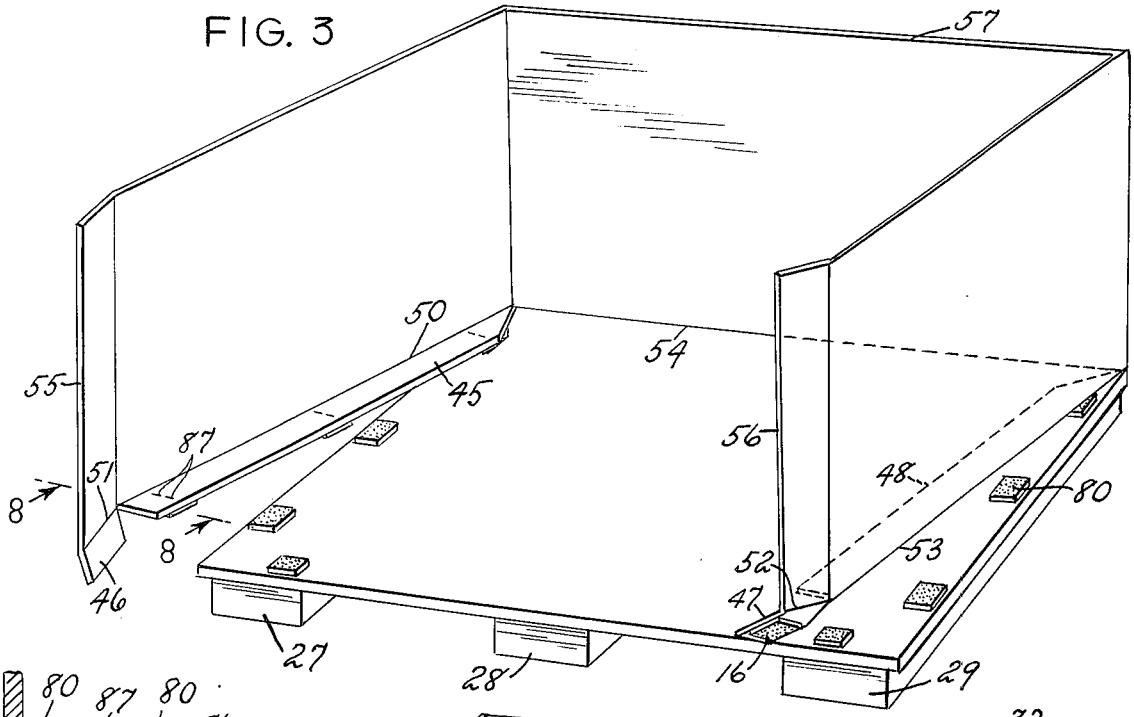
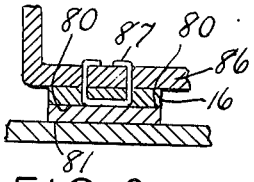
FIG. 8
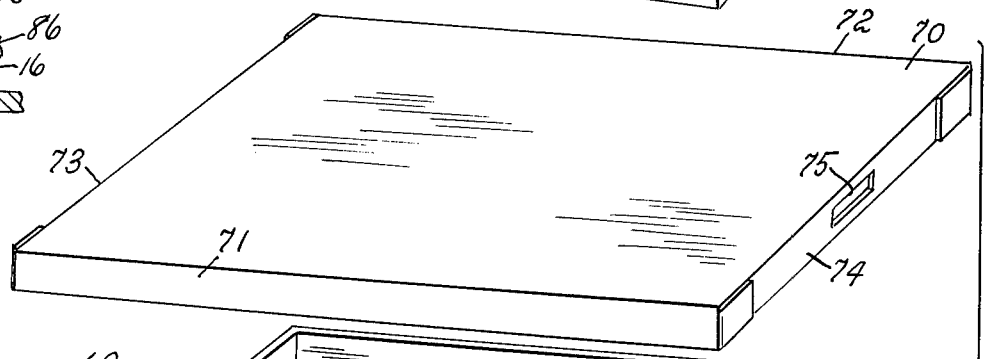
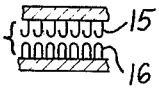
FIG. 9
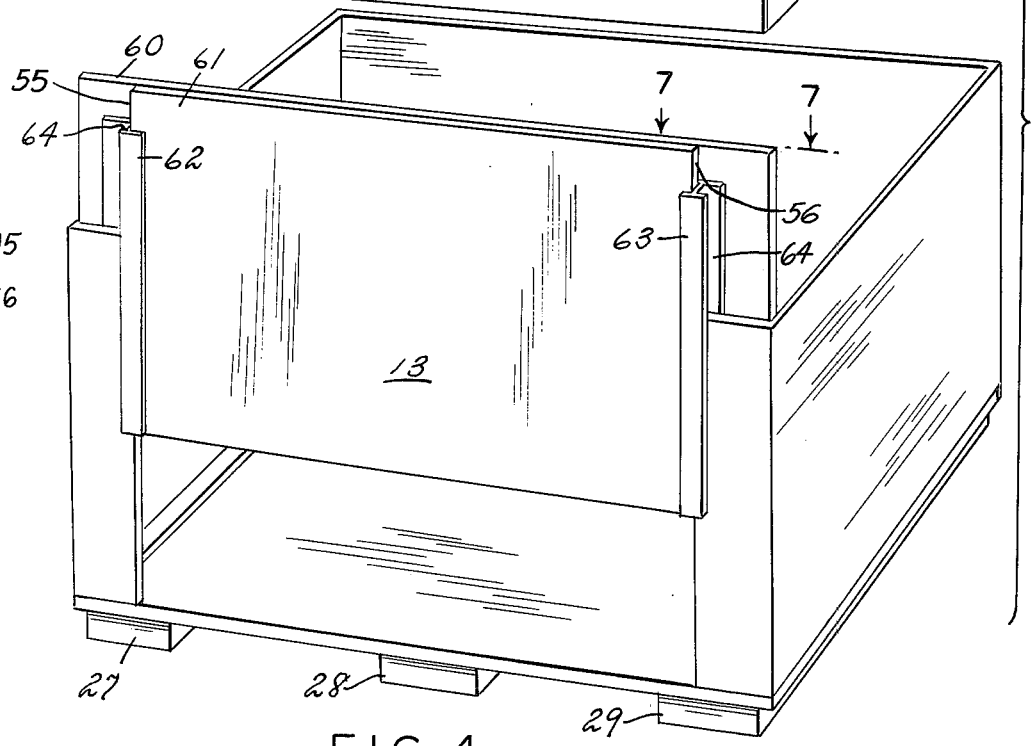
FIG. 4

COLLAPSIBLE CONTAINER CONSTRUCTION HAVING HOOK AND PILE INTERCONNECTING MEANS

BACKGROUND OF THE INVENTION

The invention relates generally to collapsible reusable shipping containers of the type disclosed in my prior U.S. Pat. No. 3,443,737 granted May 13, 1969, and more particularly to improved means in such devices for retaining the sides of such containers in erected condition for use substantially at right angles relative to the plane of the pallet. Prior art constructions have utilized various channels in which the lower edges of the walls are engaged, usually in cooperation with retaining clips, nut and bolt fastening means, screws, and related hardware. In such constructions, the use of tools is required for assembly and disassembly, as well as substantial workers' time in manipulating them. In addition, the cost of such hardware has been an ever increasing cost factor.

SUMMARY OF THE INVENTION

Briefly stated, the invention contemplates the provision of devices of the class described, in which the above mentioned hardware is substituted by hook and pile interconnecting members which are so situated that the weight of the cargo overlying the hook and pile members in interconnected condition tends to press them together to resist accidental disengagement.

BRIEF DESCRIPTION OF THE DRAWINGS

In the drawings, to which reference will be made in the specification, similar reference characters have been employed to designate corresponding parts throughout the several views.

FIG. 3 is a view in perspective showing engagement of hingedly interconnected side walls of the device with an upper surface of a rigid pallet during erection of the container.

FIG. 4 is an exploded view in perspective showing a final step in erection of the container.

FIG. 8 is a fragmentary enlarged sectional view as seen from the plane 8—8 in FIG. 3.

FIG. 9 is a fragmentary enlarged sectional view showing hook and pile means forming a part of the disclosed embodiment.

DETAILED DESCRIPTION OF THE DISCLOSED EMBODIMENTS

Figure 2:
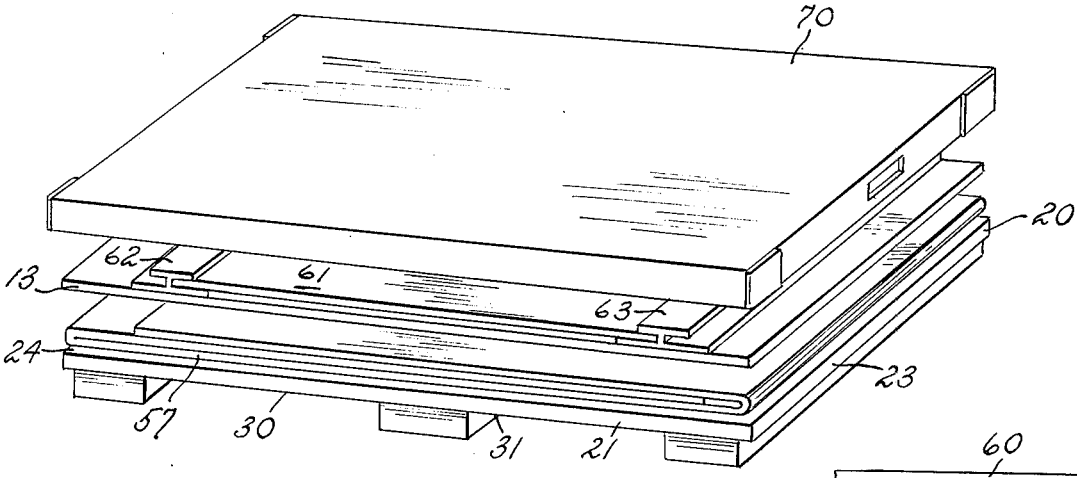
FIG. 2 is an exploded view in perspective of the first embodiment in collapsed condition.
Figure 7:
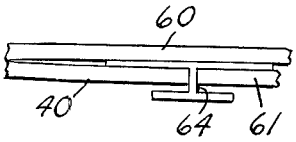
FIG. 7 is a fragmentary top plan view as seen from the plane 7—7 in FIG. 4.
Figure 1:
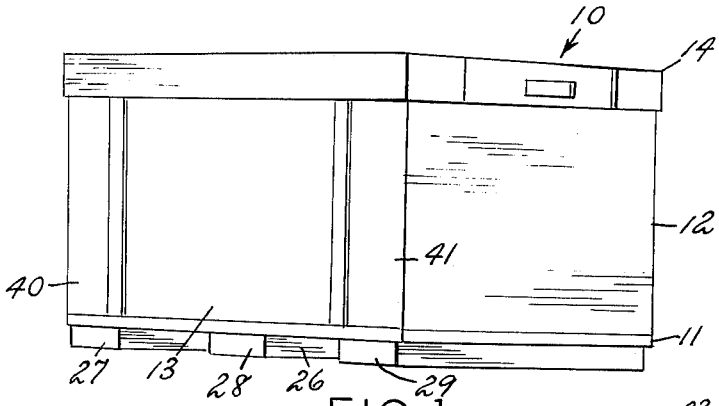
FIG. 1 is a perspective view of a first embodiment of the invention in erected condition.

In accordance with the first embodiment of the invention, the device, generally indicated by reference character 10, comprises broadly: a pallet element 11, a side wall element 12, an optional side door element 13, a lid element 14, a plurality of hooked interconnecting means 15, and a corresponding plurality of pile interconnecting means 16.

The pallet element 11 is of generally conventional construction, and may be formed either from lumber, molded synthetic resins, or, in some case of lightweight metal. It includes a floor member 20 bounded by a front edge 21, a rear edge 22, side edges 23 and 24, and an upper surface 25 mounting the means 15 and a lower surface 26 mounting a plurality of parallel skids 27, 28 and 29 defining interstices 30 for the insertion of a fork lift (not shown). The specific details of the pallet are well known in the art, and need not be further considered herein.

Figure 5:
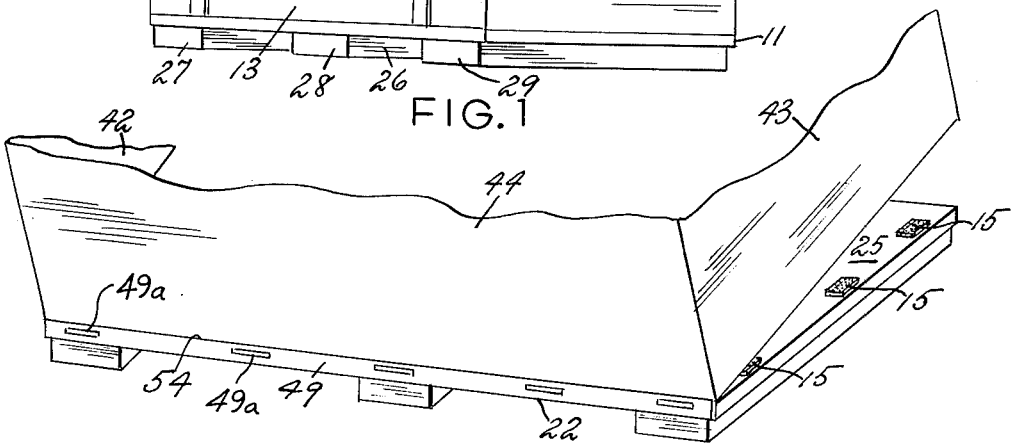
FIG. 5 is a fragmentary view in perspective corresponding to the side opposite that seen in FIG. 3.

The side wall element 12 is generally similar to that disclosed in my above mentioned prior patent, and is preferably formed from a continuous piece of corrugated cardboard. It includes front wall members 40 and 41, side wall members 42 and 43, and a rear wall member 44. Each of the above mentioned walls is provided with a lower flap, as indicated by reference characters 45, 46, 47, 48 and 49 (see FIG. 5). These flaps are interconnected by fold lines 50, 51, 52, 53 and 54, so that, with the exception of flap 49, the planes of the same may be disposed parallel to that of the upper surface of the pallet element 11 when the element 12 is in erected interconnected condition with respect thereto.

The wall members 40–41 define free vertical edges 55 and 56 with which the door element 13 is engaged, and a continuous horizontal upper edge 57 supports the lid element 14.

The door element 13, is also disclosed in my above mentioned prior patent, and briefly, it includes an inner wall 60, a laminated outer wall 61, and a pair of I-beam channel members 62 and 63 defining grooves 64 engaging the edges 55 and 56. When the lid element 14 is removed, the element 13 may be moved upwardly to disclose an opening 65 (FIG. 4).

The lid element 14 is also conventional, including a top wall 70, side walls 71 and 72, end walls 73 and 74, the latter defining openings, one of which is indicated by reference character 75 for the passage of seal means (not shown).

The hooked interconnecting means 15 may be of a type presently sold under the Trademark "VELCRO", and are of pad-like configuration to include an upper surface 80 having flexible synthetic resinous or metallic hooks (not shown). A lower surface 82 is glued or otherwise fastened to the upper surface of the pallet element 11 at periodic intervals. The corresponding pile means 16 includes a pile surface 85, the opposite surface 86 of which is glued to an undersurface of the flaps 45–48, preferably with added reinforcement in the form of a staple 87 to prevent the same from tearing loose from the cardboard surface of the flaps.

Referring to FIGS. 2 and 3, the device is readied for use in a manner not unlike that disclosed in may prior patent, the lower surface of the flaps 46–48, inclusive, being interconnected by the hook and pile interconnecting means 15–16 in lieu of mounting hardware known in the prior art.

Figure 6:
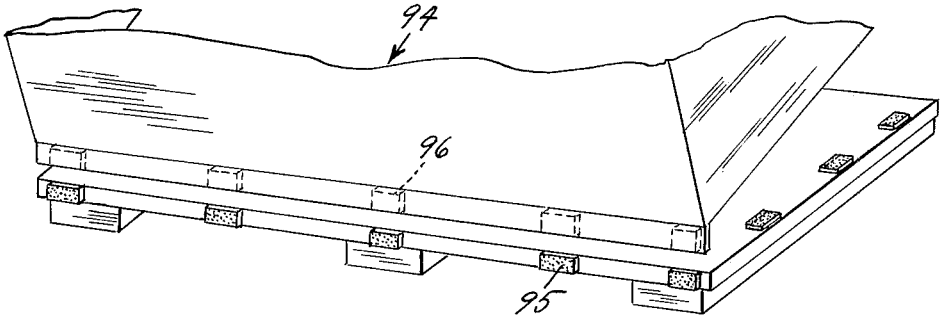
FIG. 6 is a comparable fragmentary view in perspective of a second embodiment of the invention.

Turning to the second embodiment of the invention illustrated in FIG. 6 and generally indicated by reference character 94, this embodiment differs from the principal embodiment in the substitution of additional hook and pile means 95–96 in lieu of the staples **49*a* fastening the flap 49 permanently to the pallet element. This embodiment is of particular value where the side wall element 97** will be replaced at least once during the normal life expectancy of the device, and in which case the wall element can be completely separated from the pallet element without the use of tools.

I wish it to be understood that I do not consider the invention limited to the precise details of structure shown and set forth in this specification, for obvious modification will occur to those skilled in the art to which the invention pertains.

I claim:

1. In a collapsible reusable shipping container of a type having a relatively rigid pallet element defining a floor, and a plurality of hingedly interconnected walls selectively engaged at the lower edges thereof to a surface of said pallet, improved means for accomplishing engagement of said lower edges comprising: a plurality of flaps hingedly interconnected to said side walls at said lower edges, and foldable to lie in a plane substantially at right angles with respect to the plane of a respective wall to overlie a portion of an upper surface of said rigid pallet elements; said flaps having a downwardly facing surface and cooperating hook and pile interconnecting means secured to said downwardly facing surface of said flaps and said upper surface of said pallet element, one of said flaps being interconnected to an edge surface of said pallet to permit said one of said flaps to remain attached to said pallet as the remaining flaps are disconnected prior to folding respective walls upon said pallet, and selectively allowing complete detachment of said walls for replacement.

2. Structure in accordance with claim 1, in which said one of said flaps is permanently interconnected to an edge surface of said pallet by means other than said hook and pile means.

3. Structure in accordance with claim 1, in which said one of said flaps is interconnected by hook and pile interconnecting means to a surface of said pallet other than that of the remaining flaps.

* * * * *